United States Patent [19]

Mikuni

[11] Patent Number: 4,638,750

[45] Date of Patent: Jan. 27, 1987

[54] SEWING MACHINE LOOP TAKER ATTACHING CONSTRUCTION

[75] Inventor: Yoshio Mikuni, Osaka, Japan

[73] Assignee: Maruzen Sewing Machine Co., Ltd., Osaka, Japan

[21] Appl. No.: 790,645

[22] Filed: Oct. 23, 1985

Related U.S. Application Data

[63] Continuation of Ser. No. 615,737, May 31, 1984, abandoned.

[30] Foreign Application Priority Data

Mar. 9, 1984 [JP] Japan ..... 59-34751[U]

[51] Int. Cl.[4] ..... D05B 57/08; D05B 57/36

[52] U.S. Cl. ..... 112/230

[58] Field of Search ..... 112/184, 228, 229, 230, 112/231

[56] References Cited

U.S. PATENT DOCUMENTS

| | | | |
|---|---|---|---|
| 875,621 | 12/1907 | Parkes | 112/231 |
| 1,431,380 | 10/1922 | Dickson | 112/228 |
| 1,884,178 | 10/1932 | Parkes | 112/184 X |
| 2,941,488 | 6/1960 | Attwood | 112/228 |
| 3,140,681 | 7/1964 | Corey | 112/228 |
| 3,223,060 | 12/1965 | Corey | 112/228 |
| 3,611,962 | 10/1971 | Armao | 112/228 |
| 4,297,958 | 11/1981 | Adams | 112/184 X |
| 4,397,250 | 8/1983 | Zylbert et al. | 112/184 |
| 4,475,475 | 10/1984 | Zycbert | 112/228 |
| 4,488,499 | 12/1984 | Giaimo et al. | 112/230 |
| 4,493,278 | 1/1985 | Badillo | 112/184 |

FOREIGN PATENT DOCUMENTS

| | | | |
|---|---|---|---|
| 933601 | 9/1955 | Fed. Rep. of Germany | 112/230 |
| 2445466 | 9/1975 | Fed. Rep. of Germany | 112/184 |
| 728247 | 4/1955 | United Kingdom | 112/231 |

*Primary Examiner*—Wm. Carter Reynolds

*Attorney, Agent, or Firm*—Lowe Price LeBlanc Becker & Shur

[57] ABSTRACT

A loop taker (18) has a loop taker body (20) molded of resin in one piece, and a hook (22) made of metal. A rotary shaft (13) is fitted in the center of the loop taker (18), and a set screw (17) threadedly inserted in the end of this rotary shaft holds down the loop taker (18). A pin (36) fixedly installed on the rotary shaft (13) is fitted in a radially extending groove (37) in the loop taker (18), whereby the loop taker (18) is connected to the rotary shaft (13) so that it will not rotate relative to the rotary shaft.

12 Claims, 19 Drawing Figures

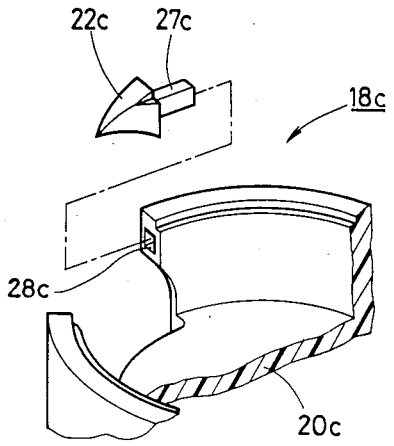
FIG. 7
FIG. 8
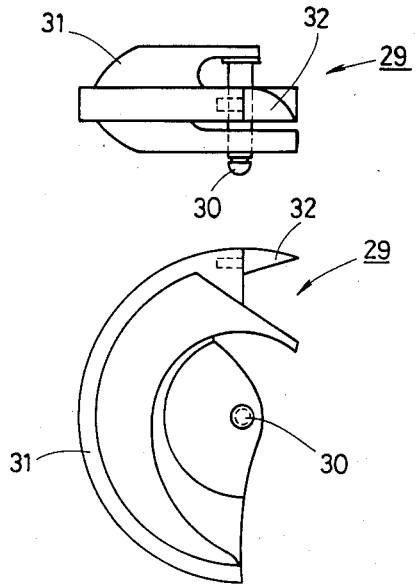
FIG. 9
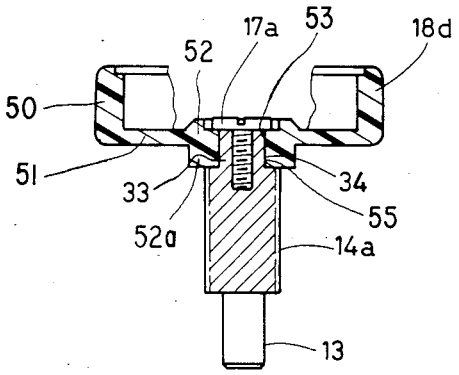
FIG. 10
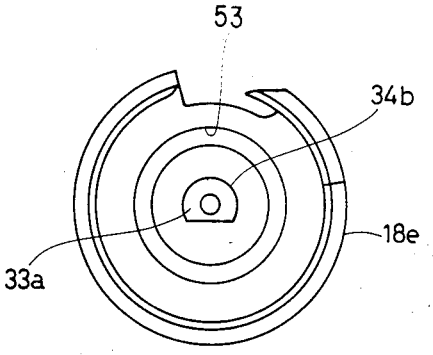
FIG. 11

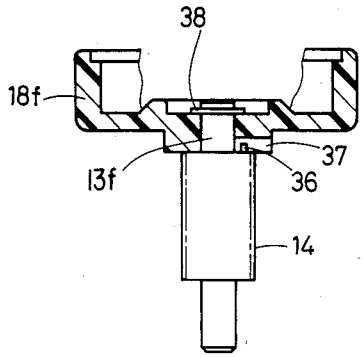
FIG. 12
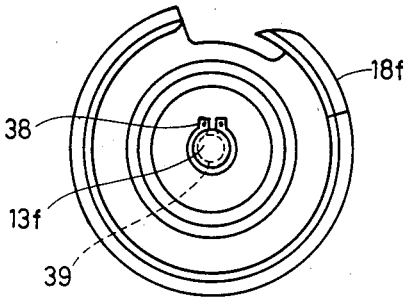
FIG. 13
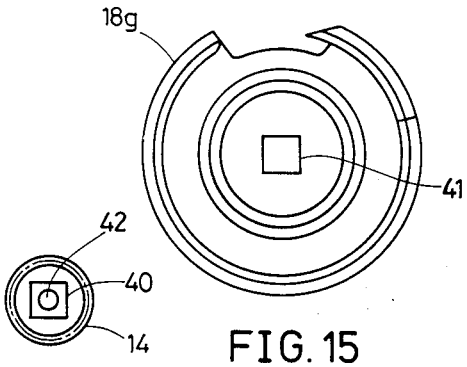
FIG. 15
FIG. 14
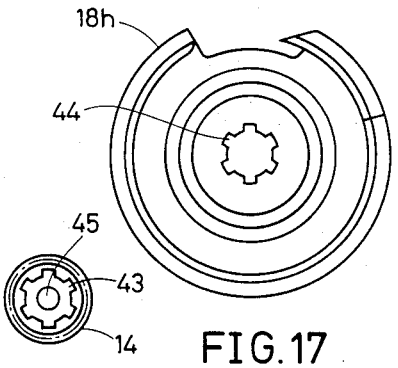
FIG. 17
FIG. 16

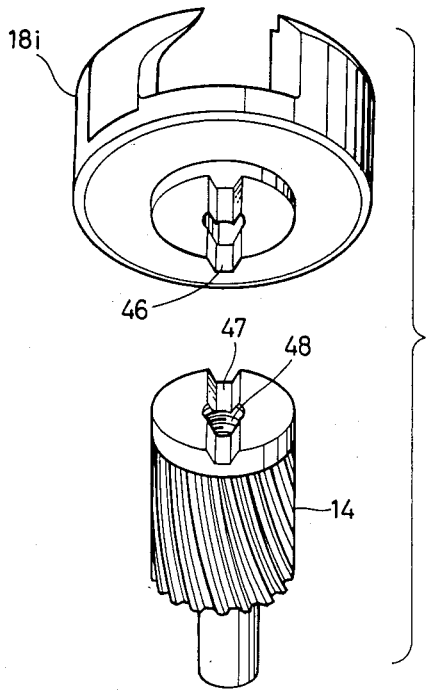
FIG. 18
FIG. 19
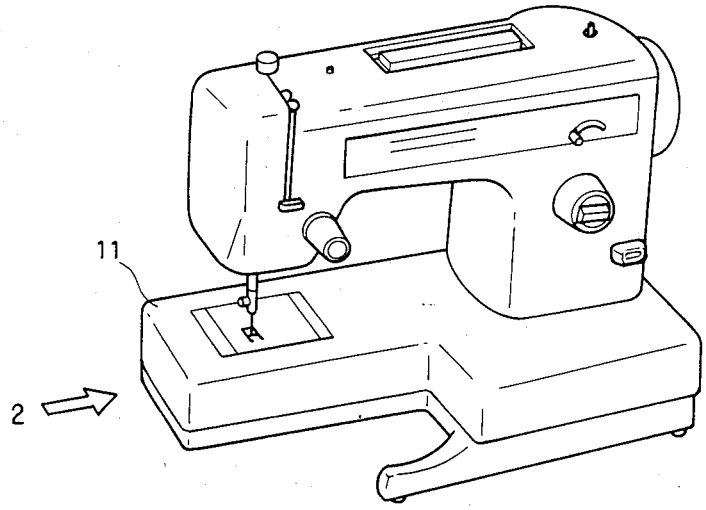

SEWING MACHINE LOOP TAKER ATTACHING CONSTRUCTION

This application is a continuation of application Ser. No. 615,737, filed May 31, 1984, now abandoned.

BACKGROUND OF THE INVENTION

This invention relates to a loop taker attaching construction in sewing machines, the loop taker having a hook for arresting a needle loop.

Loop takers having hooks are classified into two types, one used exclusively for household sewing machines in which the loop taker is oscillated, and the other used for industrial sewing machines and also for household sewing machines in recent years in which the loop taker is rotated in a horizontal plane. The manufacture of each type has involved a number of steps. For example, in the type in which the loop taker is rotated, roughly speaking its manufacture involves welding a ring-like metal part and a bottom lid to unite them, grinding a notch to form a hook, and removing burrs and buffing the surface to ensure smooth slide movement of the yarn, the operation amounting to as many as 30 steps. Similarly, the type in which the loop taker is oscillated requires a large number of manufacturing steps. Such largeness of the number of steps increases the manufacturing cost of the shuttle race and body assembly, and the larger the number of steps, the greater the percentage occurrence of reject parts, which, in turn, increases the manufacturing cost of the shuttle race and body assembly.

This problem can be solved by molding the loop taker of resin. Since the production of loop takers can be effected in one steps, the manufacturing cost is reduced to a large extent. Further, the molding of loop takers of resin provides the following advantages in addition to the reduction of manufacturing cost.

First, vibration and noise produced by the rotating or oscillating movement of the loop taker are absorbed. Such vibration and noise are produced when the needle loop passing over the loop taker comes out from between the loop taker and the shuttle driver, which is driven to oscillate the loop taker, at which time the two strike against each other, or when the needle loop comes out from between the bobbin case, which is carried by the loop taker, and the retainer of the bobbin case in order to pass over the bobbin case.

Second, the inertia force is reduced because of the reduction in weight.

Third, if a resin of satisfactory lubrication is used, this eliminates the need for oiling and produces no creak. If a resin having a low coefficient of friction is used, the loop taker will move smoothly.

However, a loop taker made of resin, as compared with one made of metal, has a disadvantage that its strength and wear resistance are low. This has been a major cause of baffling a realization of its practical use. This problem must be solved before a loop taker make of resin can be put to practical use.

The rotating type loop taker has another problem which follows.

When it is needed to replace the loop taker or to clean it, the dismounting and mounting of the loop taker is not easy. The need of replacing the loop taker arises (1) when the timing between the loop taker and the needle goes out of order or the needle is bent and hence the needle point strikes against the hook and thereby breaks or damages the hook, (2) when the loop taker is rusted, (3) when the yarn does not slide smoothly, and (4) when the loop taker is worn out. The need for cleaning the loop taker arises (1) when waste pieces of yarn have accumulated, and (2) when the yarn tends to be contaminated with lubricating oil or the like.

For example, in the type shown in FIG. 1 in which a loop taker 1 is rotated in a horizontal direction, the removal of the loop taker 1 would involve the following operation. First, a base cover 2 may be removed to loosen fixing screws 3 and then a driver shaft 4 may be withdrawn. However, since the loop taker 1 is generally provided with a gear 5 integral therewith, the withdrawal of the loop taker together with said gear 5 would be obstructed by such parts as a feed mechanism 6, a lower shaft 7, and a gear 8 meshing with the gear 5 and fixed on the lower shaft 7. Therefore, the downward withdrawal of the loop taker 1 is impossible. On the other hand, the upward withdrawal of the loop taker 1, which is not obstructed by the aforesaid machine elements, is not so easy since the space defined below the head 9 of the sewing machine is narrow.

SUMMARY OF THE INVENTION

A principal object of this invention is to facilitate the mounting and dismounting of a rotary type loop taker.

In this invention, the loop taker is formed separately from the shaft means for transmitting rotation to said loop taker and is removably attached to the shaft means by fixing means.

More specifically, a sewing machine loop taker attaching construction attachable to a first rotary shaft for transmitting rotation to the loop taker, with the rotary shaft driven by a second shaft through meshing gears carried on the shafts, comprises a loop taker body having a base portion and a side wall projecting upward from the base portion. The side wall carries a hook for arresting a needle loop. Means is provided for removably attaching the loop taker body to the first rotary shaft. The attaching means connects the base portion of the loop taker body to an upper end of the first shaft and is accessible from a top side of the loop taker body facing a sewing machine needle for fastening and unfastening the loop taker with respect to the first shaft without interrupting the meshing state of the gears. Support means is provided for securing the first shaft in an axially immovable position and formed separately from the attaching means to prevent interruption of the meshing state of the gears when the attaching means is operated to remove the loop taker body from the first shaft.

In an embodiment of the invention, the loop taker is attached to the end surface of the shaft means by a set screw. Support means is provided for securing the first shaft in an axially immovable position and formed separately from the set screw to prevent interruption of the meshing state of the gears when the set screw is loosened to remove the loop taker body from the first shaft. While the loop taker can be fixed to the shaft means by the set screw in this manner, preferably, rotation preventing means is separately provided and the set screw is adapted to have only the function of pressing the loop taker against the shaft means. In another embodiment wherein rotation preventing means is separately provided, a C-shaped or E-shaped stop ring is used to attach the loop taker to the shaft means.

Examples of the rotation preventing means are as follows.

(1) A socket is formed either in the shaft means or in the loop taker, while a spigot adapted to fit in said socket is formed on the other, the cross-sectional shape of said socket and spigot being a notched circle or a quadrangle.

(2) An axially or radially extending groove is formed either in the shaft means or in the loop taker, while a ridge adapted to fit in said groove is formed on the other.

(3) A radially or axially extending pin is provided on either the shaft means or the loop taker, while the other is provided with a radially extending groove or axially extending pin fitting hole in which said pin fits.

(4) The shaft means is in the form of a spline shaft.

The rotation preventing means as described above can be utilized as positioning means in rotative direction when the loop taker is attached to the shaft means in such a manner as to establish the timing with respect to the needle. To serve as such positioning means, the forms of said rotation preventing means described in Item Nos. (1) through (3), preferably (2) and (3) are used. This is because at the same time as the loop taker is attached to the shaft means; the positioning is effected, eliminating the need to adjust or change the attaching position to establish the timing with respect to the needle.

The base portion of the loop taker is preferably formed with a central hub adapted to connect to the first shaft. The central hub is of short longitudinal extent relative to the diameter of the base to thereby interfit only with the upper end of the first shaft.

Accordingly, another object of this invention is to provide means having a dual function of prevention of rotation and positioning to thereby effect reliable fixing of the loop taker to the shaft means and facilitate establishment of the timing with respect to the needle when the loop taker is installed.

BRIEF DESCRIPTION OF THE DRAWINGS

FIGS. 5, 6, and 7 are fragmentary enlarged perspective views of loop takers according to other embodiments of the invention, respectively, with the hooks shown removed from the respective loop taker bodies;

FIG. 8 is a plan view of a further embodiment of the invention, showing a loop taker of the oscillating type;

FIG. 9 is a front view of the loop taker of FIG. 8;

FIG. 10 is a sectional view of a loop taker adapted to rotate in a horizontal plane, showing a first embodiment concerning a removable arrangement applied to loop takers;

FIG. 11 is a plan view of a loop taker, showing an arrangement in which a removable loop taker is provided with rotation preventing means;

FIG. 12 is a sectional view of a loop taker, showing a second embodiment concerning the removable arrangement applied to loop takers and also showing rotation preventing and positioning means added to the loop taker;

FIG. 13 is a plan view of the loop taker shown in FIG. 12;

FIGS. 14 and 15 are views for explaining other examples of the loop taker rotation preventing means, of which FIG. 14 is a plan view of shaft means for rotatively driving the loop taker and FIG. 15 is a plan view of the loop taker;

FIG. 16 and 17 are views for explaining other examples of the loop taker rotation preventing means, of which FIG. 16 is a plan view of shaft means for rotatively driving the loop taker and FIG. 17 is a plan view of the loop taker;

FIG. 18 shows loop taker rotation preventing means, with the loop taker shown in a perspective view as seen from obliquely below and the shaft means shown in a perspective view as seen from obliquely above; and FIG. 19 is an external perspective view showing an example of a sewing machine having a loop taker of this invention.

DESCRIPTION OF THE PREFERRED EMBODIMENTS

Figure 1:
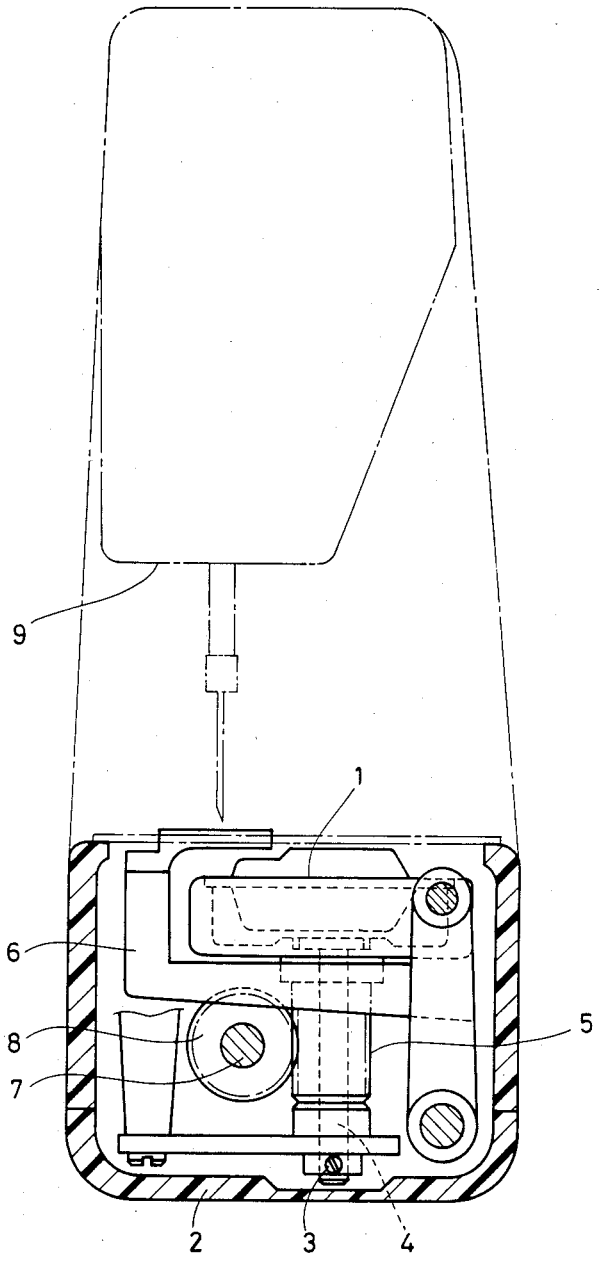
FIG.1 PRIOR ART
FIG. 1 is a view showing, partly in section, a conventional typical sewing machine having a loop taker adapted to rotate in a horizontal plane.
Figure 2:
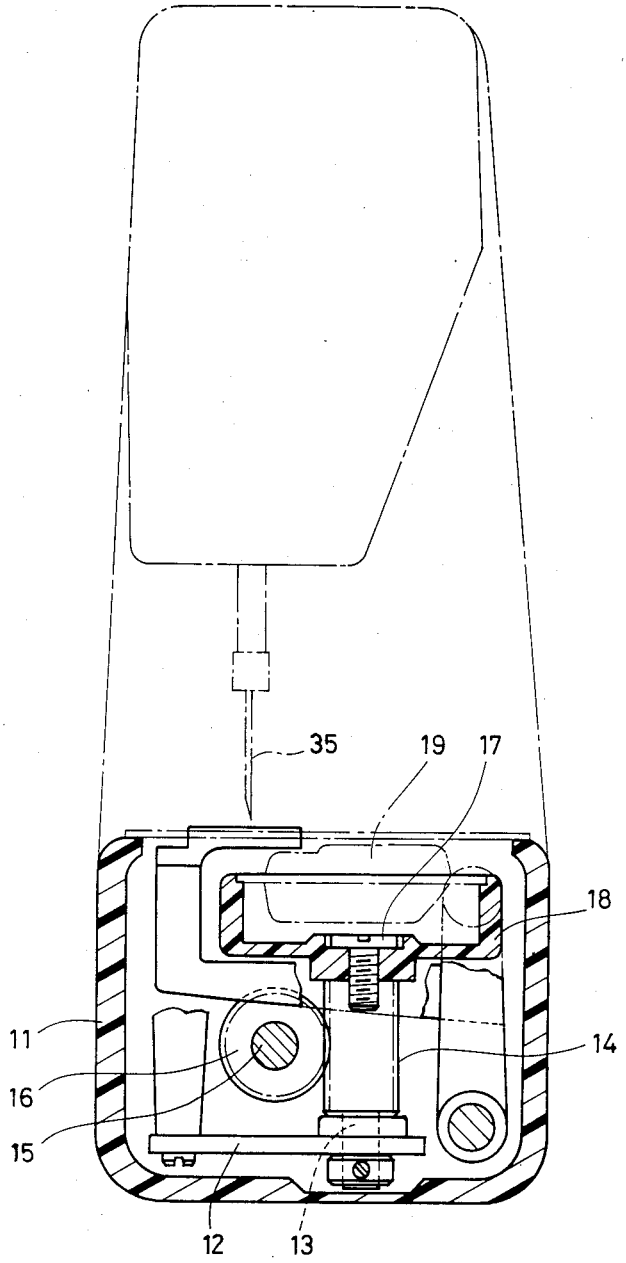
FIG. 2 is a view showing, partly in section, a sewing machine having a loop taker adapted to rotate in a horizontal plane, according to an embodiment of the invention.

FIG. 19 shows the external appearance of a sewing machine having applied thereto a loop taker according to this invention. A sectional view taken in the direction of arrow 2 of FIG. 19 is shown in FIG. 2. In addition, FIG. 1 previously described is also taken in the same direction.

In FIG. 2, a rotary shaft 13 rotatively supported by a support 12 within a bed 11 holds a spiral gear 14 on its outer peripheral surface and rotates integrally with said spiral gear 14. The spiral gear 14 meshes with a spiral gear 16 on a lower shaft 15, whereby rotary driving force imparted to the lower shaft 15 is transmitted to the rotary shaft 13 and hence the latter is rotated. A loop taker 18 is removably installed on the upper end of the spiral gear 14 by a set screw 17. Thus, the loop taker 18 is so held that it can be rotated together with the rotary shaft 13 in a horizontal plane. A bobbin case 19 is stationary held in a hold (not shown). The loop taker 18 rotates around the bobbin case 19 to arrest a needle loop as is well known.

Figure 3:
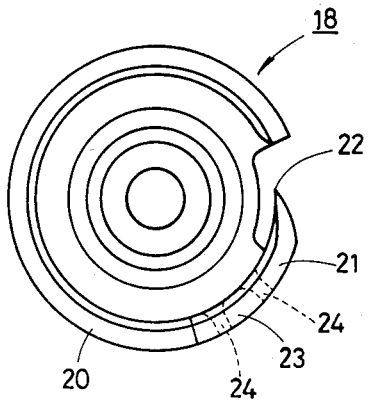
FIG. 3 is a plan view of the loop taker of FIG. 2, wherein the hook is formed of a press-worked metal sheet.
Figure 4:
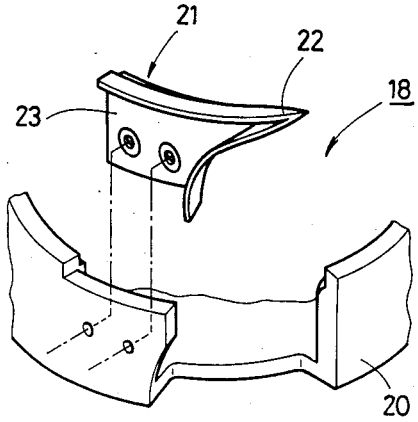
FIG. 4 is a fragmentary enlarged perspective view showing the loop taker of FIG. 3, with the hook shown removed from the loop taker body.

As shown in FIGS. 3 and 4, the loop taker 18 is composed of two parts, a loop taker body 20 and a hooked attachment 21. The loop taker body 20 is molded of resin in one piece. The hooked attachment 21 is formed of a press-worked metal sheet. The hooked attachment 21 is formed with a hook 22 and an attaching portion 23. The hooked attachment 21 is attached at its attaching portion 23 to the inner periphery of the loop taker body 20 by set screws 24.

Figure 5:
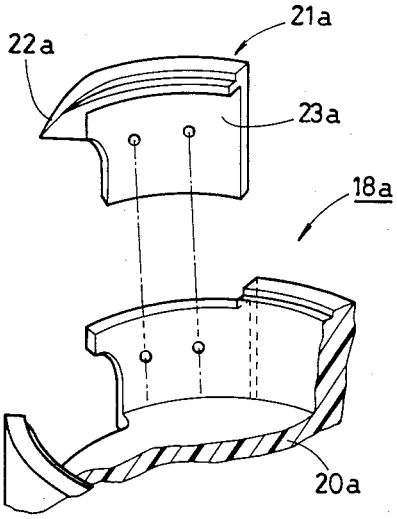

In a loop taker **18*a* shown in FIG. 5, a hooked attachment 21*a* is made of metal by casting and forging, preferably cold forging. The hooked attachment 21*a* has a hook 22*a* and an attaching portion 23*a*. The hooked attachment 21*a* is attached at its attaching portion 23*a* to the outer periphery of the loop taker body 20*a*** by set screws (not shown).

Figure 6:
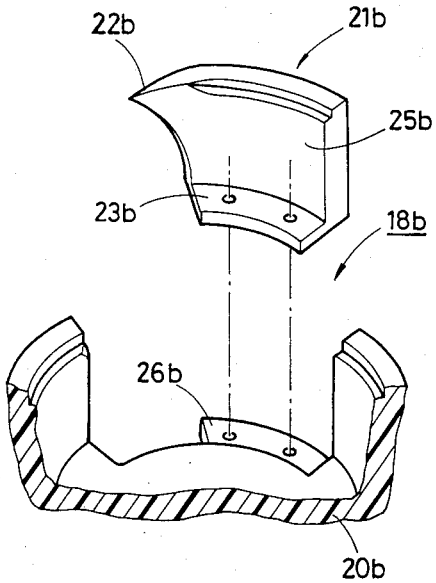

A loop taker **18*b* shown in FIG. 6 is composed of a loop taker body 20*b* and a hooked attachment 21*b*. The hooked attachment 21*b* is obtained by using the same material and same processing method as in the hooked attachment 21*a* shown in FIG. 5. The hooked attachment 21*b* has a hook 23*b*, an attaching portion 22*b*, and a peripheral side portion 25*b***. The hooked attachment 21*b* is attached at its attaching portion 23*b* to the attaching portion 26*b* of the loop taker body 21*b* by set screws (not shown). In this attached state, the peripheral side portion 25*b* forms a portion nearer to the hook, i.e., the portion which should originally constitute the peripheral side of the loop taker.

A loop taker 18*c* shown in FIG. 7 has only its hook 22*c* made of metal. The hook 22*c* is integrally formed with an insert portion 27*c* adapted to fit in a fitting hole 28*c* formed in the loop taker body 20*c*, whereby the hook 22*c* is attached to the loop taker body 20*c*. In addition, fitting of the insert portion 27*c* into the fitting hole 28*c* may be forcibly effected so that such fitting itself is sufficient to fix the hook 22*c* to the loop taker body 20*c* or it may be combined with the use of a set screw or an adhesive agent.

The embodiments described above refer to the rotating type loop taker, but in the oscillating type loop taker the hook may be similarly made of metal while making the loop taker body of resin.

An example is shown in FIGS. 8 and 9. In FIGS. 8 and 9, a loop taker 29 is of the type adapted to be oscillated around the axis of a shaft 30. The loop taker 29 is composed of a loop taker body 31 made of resin and a hook 32 made of metal. The hook 32 is of substantially the same shape as the hook 22*c* shown in FIG. 7 and substantially the same attaching means is employed.

In the above embodiments, the hook is made of metal. However, the arrangement for imparting wear resistance to the hook while making the loop taker body of resin is not limited to the manners described above, and the following method may also be used. That is, the entire loop taker including the hook may be made of resin while applying vapor deposition of metal to the hook, preferably to the hook and the portions of the loop taker body rubbed by the yarn, more preferably to the entire loop taker. Further, the loop taker may be formed in two steps by making the hook and rubbed portions of wear resistant resin in advance and then, with these positioned in a mold, performing the molding of the loop taker using ordinary resin. In each case, since wear resistance is imparted to the hook, or the most wearable portion, even if the loop taker body is made of resin the loop taker can be put to practical use.

In cases where at least a portion of the loop taker is made of resin, the need for replacement due to wear will arise more frequently than where it is made of metal. Further, even in the case of a loop taker made of metal, it sometimes becomes necessary to remove it for cleaning or other purposes. The loop taker 18 shown in FIG. 2 can be easily attached to or detached from the spiral gear 14 by tightening or loosening the set screw 17, but in attachment it is necessary to align the loop taker axially with the rotary shaft 13. In the arrangement shown in FIG. 2, the positioning for aligning them with each other is effected by the alignment between a tapped hole formed in the upper end of the spiral gear 14 and a tapped hole formed in the center of rotation of the loop taker 18.

More specifically, loop taker 18*d* includes a side wall 50 and a base portion 51 formed with a central hub 52 having a cylindrical hub wall 52*a* depending downwardly below the base portion. The cylindrical hub 52 includes a socket 53 having a cross-sectional shape in the form of a chipped circle (see FIG. 11) and a spigot which may be fitting shaft 33 formed in an upper end of the first shaft 13. Spigot 33 has a cross-sectional shape substantially the same as that of socket 53 so taht it is fitted in the socket. The meshing gear 14*a* is disposed below the spigot 33, the spigot being of lesser diameter than the meshing gear to define an upwardly facing annular shoulder 55 therewith. Further, their alignment may be attained in a manner shown in FIG. 10.

FIG. 10 shows an example in which a fitting shaft 33 projects from the upper end of a spiral gear 14*a* and adapted to fit in a fitting hole 34 in a loop taker 18*d*. The loop taker 18*d* and the spiral gear 14*a* are fixed together by an attaching screw 17*a* having a head larger in diameter than the fitting hole 34. In addition, in the example shown in FIG. 10, the fitting shaft 33 may be formed as an extension of the rotary shaft 13.

It is desirable that the loop taker 18 attached to the spiral gear 14 or to the rotary shaft 13 be provided with rotation preventing means so that when the set screw 17 is loosened during use, the loop taker will not deviate in the direction of rotation to upset the timing with respect to the needle 35 (FIG. 2). An example of rotation preventing means is shown in FIG. 11.

Referring to FIG. 11, a fitting shaft 33*a* formed on the upper end of the spiral gear and a fitting hole 34*b* in a loop taker 18*e* to receive it each have a cross-sectional shape in the form of a chipped circle.

FIGS. 12 and 13 show another example of rotation preventing means. A rotary shaft 13*f* projects from the upper end surface of the spiral gear 14. A pin 36 projects from the upper end surface of the spiral gear 14 so that it is parallel to the rotary shaft 13*f*. Further, the lower surface of a loop taker 18*f* is formed with a radially extending groove or recess 37, in which the pin 36 is fitted. Such rotation preventing means also has the function of positioning means in rotative direction needed for establishing the timing with respect to the needle (FIG. 2) when the loop taker 18*f* is set in position, whereby the attachment of the loop taker 18*f* is further facilitated. Further, in this embodiment, because of the provision of the rotation preventing means, it is possible to use a C-shaped stop ring 38 or E-shaped stop ring (not shown) rather than a set screw (such as the set screw 17*a* of FIG. 10). For example, the C-shaped ring 38 is fitted in a circumferentially extending peripheral groove 39 formed in the end of a rotary shaft 13*f* projecting from the bottom surface of the loop taker 18*f*, whereby the spiral gear 14 and the loop taker 18*f* are fixed together.

FIGS. 14 and 15 show a further example of rotation preventing means. That is, the spiral gear 14 is formed with a spigot 40 of quadrilateral cross-section, while a loop taker 18*g* is formed with a socket 41 whose cross-sectional shape is substantially the same as that of the spigot 40. When the spigot 40 is fitted in the socket 41, the rotation preventing function is developed. In addition, for fixing the spiral gear 14 and loop taker 18*g*, a set screw (not shown) is used in the manner shown in FIG. 10, and for this purpose a tapped hole 42 is formed in the spigot 40.

As a variation of the example shown in FIGS. 14 and 15, the sides where the spigot and the socket are provided, respectively, may be interchanged.

FIGS. 16 and 17 show still another example of rotation preventing means. The spiral gear 14 is formed with spline teeth 43, while a loop taker 18*h* is formed with a fitting hole 44 for receiving the spline teeth 43. In this example, too, a set screw is used and hence a tapped hole 45 therefor is formed in the spline teeth 43.

In addition, as a modification of the example shown in FIGS. 16 and 17, the sides where the spline teeth and the fitting hole are provided, respectively, may be interchanged.

FIG. 18 shows yet another example of rotation preventing means. In this example, a loop taker 18*i* is formed with a radially extending ridge 46, while the spiral gear 14 is formed with a likewise radially extending recess 47. With the ridge 46 fitted in the recess 47, a set screw (not shown) is threadedly inserted in a tapped hole 48, whereby the loop taker 18*i* is fixed to the spiral gear 14. In addition, the tapers appearing on both sides of the ridge 46 and recess 47, respectively, provide an advantage that the aforesaid fitting can be easily attained.

In addition, as a modification of the example shown in FIG. 18, the sides where the ridge and the recess are formed, respectively, may be interchanged.

Although the present invention has been described and illustrated in detail, it is clearly understood that the same is by way of illustration and example only and is not to be taken by way of limitation, the scope of the present invention being limited only by the terms of the appended claims.

What is claimed is:

1. A sewing machine loop taker attaching construction attachable to a first rotary shaft for transmitting rotation to said loop taker, said rotary shaft driven by a second shaft through meshing gears carried on said shafts, one of said meshing gears carried on said first rotary shaft being integral with said shaft, comprising a loop taker body having a base portion and a side wall projecting upward from the base portion, said base portion being formed with a central hub having a cylindrical hub wall depending downwardly below the base portion, said cylindrical hub including a socket having a cross-sectional shape in the form of a chipped circle, and a spigot formed in an upper end of the first shaft whose cross-sectional shape is substantially the same as that of said socket so that it is fitted in said socket, said meshing gear being disposed below said spigot, said spigot being of lesser diameter than said meshing gear to define an upwardly facing annular shoulder therewith, said side wall carrying a hook for arresting a needle loop, and means for removably attaching said loop taker body to said first rotary shaft, said attaching means connecting the central hub of the loop taker body to said spigot inserted with said socket with the cylindrical hub wall seated upon said shoulder and said attaching means being accessible from a top side of the loop taker body facing a sewing machine needle for fastening and unfastening the loop taker with respect to the first shaft by removal of the central hub from the spigot without interrupting the meshing state of said gears; and support means for securing said first shaft in an axially immovable position and formed separately from said attaching means to prevent interrruption of the meshing state of said gears when said attaching means is operated to remove the loop taker body form the first shaft.

2. A loop taker attaching construction as set forth in claim 1, wherein the body of said loop taker is molded of resin, while said hook is formed separately from said loop taker so as to have wear resistance.

3. A loop taker attaching construction as set forth in claim 2, wherein said hook is made entirely of metal and fixed to the loop taker body.

4. A loop taker attaching construction as set forth in claim 3, wherein said hook is formed by cold forging.

5. A loop taker attaching construction as set forth in claim 2, wherein a press-formed metal sheet is applied to cover the hook.

6. A loop taker attaching construction as set forth in claim 3, wherein said hook has an attaching portion through which it is attached to the loop taker body.

7. A loop taker attaching construction as set forth in claim 3, wherein said hook has an insert portion, while said loop taker body has a fitting hole for receiving said insert portion, said insert portion being fitted in said fitting hole, whereby said hook is attached to said loop taker body.

8. A loop taker attaching construction as set forth in claim 2, wherein said hook has its surface formed by vapor deposition of metal.

9. A loop taker attaching construction as set forth in claim 2, wherein said hook is made of wear resistant resin.

10. The loop taker of claim 1, wherein said hub wall is thicker in its diametral direction than the base portion of the loop taker body.

11. A sewing machine loop taker attaching construction attachable to a first rotary shaft for transmitting rotation to said loop taker, said rotary shaft driven by a second shaft through meshing gears carried on said shafts, one of said meshing gears carried on said first rotary shaft being integral with said shaft, comprising a loop taker body having a base portion and a side wall projection upward from the base portion, said base portion being formed with a central hub having a cylindrical hub wall depending downwardly below the base portion, said cylindrical hub including a socket having a cross-sectional shape in the form of a chipped circle, and a spigot formed in an upper end of the first shaft whose cross-sectional shape is substantially the same as that of said socket so that it is fitted in said socket, said meshing gear being disposed below said spigot, said spigot being of lesser diameter than said meshing gear to define an upwardly facing annular shoulder therewith, said side wall carrying a hook for arresting a needle loop, and means for removably attaching said loop taker body to said first rotary shaft, said attaching means being a set screw extending through the base portion for connection to an upper end of said first shaft, said screw being accessible from a top side of the loop taker body for fastening and unfastening the loop taker body with respect to the first shaft by removal of the central hub from the spigot without interrupting the meshing state of said gears; and support means for securing said first shaft in an axially immovable position and formed separately from said set screw to prevent interruption of the meshing state of said gears when said set screw is loosened to remove the loop taker body from the first shaft.

12. The loop taker of claim 11, wherein said hub wall projects above the upper surface of the base portion and is formed with an upwardly directed recess into which the head of the set screw is received.

* * * * *